US010575102B2

(12) United States Patent
Naumann

(10) Patent No.: US 10,575,102 B2
(45) Date of Patent: Feb. 25, 2020

(54) METHOD FOR OPERATING A HEARING AID APPARATUS AND HEARING AID APPARATUS

(71) Applicant: SIVANTOS PTE. LTD., Singapore (SG)

(72) Inventor: Frank Naumann, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/883,304

(22) Filed: Jan. 30, 2018

(65) Prior Publication Data

US 2018/0220241 A1 Aug. 2, 2018

(30) Foreign Application Priority Data

Jan. 30, 2017 (DE) ..... 10 2017 201 457

(51) Int. Cl.
*H04R 25/00* (2006.01)

(52) U.S. Cl.
CPC ..... *H04R 25/305* (2013.01); *H04R 25/505* (2013.01); *H04R 25/552* (2013.01); *H04R 25/554* (2013.01); *H04R 2225/39* (2013.01); *H04R 2225/55* (2013.01)

(58) Field of Classification Search
CPC ..... H04R 2225/025; H04R 25/402; H04R 25/405; H04R 2225/041; H04R 2225/51; H04R 2225/55; H04R 2460/03; H04R 25/552; H04R 25/305; H04R 25/55; H04R 25/554; H04R 25/556; A61F 11/045; A63F 13/285
USPC ..... 381/312, 313, 314, 315, 328, 329
See application file for complete search history.

(56) References Cited

U.S. PATENT DOCUMENTS

| | | | | |
|---|---|---|---|---|
| 8,175,305 | B2 | 5/2012 | Chew et al. | |
| 8,189,835 | B2 * | 5/2012 | Dietz | H04R 25/554 381/312 |
| 9,596,551 | B2 * | 3/2017 | Pedersen | H04R 1/1041 |
| 2012/0195449 | A1 * | 8/2012 | Thiede | H04R 25/305 381/315 |

(Continued)

FOREIGN PATENT DOCUMENTS

| | | | |
|---|---|---|---|
| EP | 2109331 | A2 | 10/2009 |
| EP | 2150076 | A2 | 2/2010 |

(Continued)

*Primary Examiner* — Binh Kien Tieu
(74) *Attorney, Agent, or Firm* — Laurence A. Greenberg; Werner H. Stemer; Ralph E. Locher

(57) ABSTRACT

A method is provided for operating a hearing aid apparatus including two hearing aids being signal-coupled by a wireless first communication link with a comparatively short range and by a wireless second communication link with a comparatively long range. Each hearing aid has an integrated motion sensor for capturing a fall of the respective hearing aid. A first signal level of the first communication link is monitored and compared to a stored first threshold in each hearing aid. A notification signal is transmitted from the first hearing aid over the second communication link when the motion sensor captures a fall and the first signal level reaches or drops below the first threshold. Upon reception of the notification signal, a perceivable first information signal is produced by the second hearing aid as a protection against loss. A hearing aid apparatus is also provided for carrying out the method.

12 Claims, 2 Drawing Sheets

(56) References Cited

U.S. PATENT DOCUMENTS

| | | | | |
|---|---|---|---|---|
| 2014/0023216 | A1* | 1/2014 | Solum | H04R 25/554 381/315 |
| 2015/0124976 | A1* | 5/2015 | Pedersen | H04R 25/552 381/23.1 |
| 2015/0318613 | A1* | 11/2015 | Kerselaers | H01Q 7/005 381/315 |
| 2016/0323678 | A1* | 11/2016 | Pontoppidan | H04R 25/552 |
| 2017/0238103 | A1* | 8/2017 | Gehring | H04R 25/552 381/23.1 |
| 2017/0257713 | A1* | 9/2017 | Westermann | G06F 19/3418 |
| 2017/0289704 | A1 | 10/2017 | Frederiksen et al. | |
| 2018/0040230 | A1* | 2/2018 | Benoit | G08B 25/016 |
| 2018/0078422 | A1* | 3/2018 | Dierenbach | A61F 11/045 |
| 2018/0084352 | A1* | 3/2018 | Riis | H04R 25/558 |
| 2018/0124526 | A1* | 5/2018 | Solum | H04L 63/06 |
| 2018/0249259 | A1* | 8/2018 | Westermann | H04R 25/554 |
| 2018/0249260 | A1* | 8/2018 | Solum | H04R 25/554 |
| 2019/0110138 | A1* | 4/2019 | Pedersen | A61N 1/36038 |

FOREIGN PATENT DOCUMENTS

| | | | |
|---|---|---|---|
| EP | 2908549 | A1 | 8/2015 |
| EP | 3035710 | A2 | 6/2016 |
| WO | 2014184395 | A2 | 9/2014 |

* cited by examiner

METHOD FOR OPERATING A HEARING AID APPARATUS AND HEARING AID APPARATUS

CROSS-REFERENCE TO RELATED APPLICATION

This application claims the benefit, under 35 U.S.C. § 119, of German patent application DE 10 2017 201 457.1, filed Jan. 30, 2017; the prior application is herewith incorporated by reference in its entirety.

BACKGROUND OF THE INVENTION

Field of the Invention

The invention relates to a method for operating a hearing aid apparatus having two hearing aids which are signal-coupled to one another. The invention also relates to a hearing aid apparatus that is operable according to the method.

Hearing aid apparatuses are portable hearing aids which serve to treat the hard of hearing or hearing-impaired persons. In order to accommodate numerous individual requirements, provision is made for different designs of hearing aid apparatuses, such as behind-the-ear (BTE) hearing aids, hearing aids with an external receiver (RIC: receiver in the canal) and in-the-ear (ITE) hearing aids, for example, as well as concha hearing aids or canal hearing aids (CIC: completely in canal; IIC: invisible in canal). The hearing aids listed in an exemplary manner are worn on the outer ear or in the auditory canal of a hearing aid apparatus user. However, bone conduction hearing aids and implantable or vibrotactile hearing aids are moreover also commercially available. In this case, the damaged ear is stimulated either mechanically or electrically.

In principle, such hearing aids include, as important components, an input transducer, an amplifier and an output transducer. As a rule, the input transducer is an acousto-electric transducer, such as e.g. a microphone, and/or an electromagnetic receiver, for example an induction coil or a (radiofrequency, RF) antenna. The output transducer is usually realized as an electroacoustic transducer, for example as a miniaturized loudspeaker (receiver), or as an electromechanical transducer, such as e.g. a bone conduction receiver. The amplifier is usually integrated into a signal processing device. A battery or a rechargeable accumulator usually provides an energy supply.

In the case of a so-called binaural hearing aid apparatus, a user wears two such hearing aids, with a communication link existing between the hearing aids. In that case, data, optionally large amounts of data as well, are exchanged in wireless fashion between the hearing aid at the right ear and the hearing aid at the left ear during operation. The exchanged data and information facilitate a particularly effective adaptation of the hearing aids to a respective acoustic situation. In particular, it facilitates a particularly authentic surround sound for the user and improves the understanding of speech, even in loud environments.

Preferably, hearing aids have a structure that is particularly space-saving and compact so that they can be worn as inconspicuously as possible by a hearing aid apparatus user. As a result, increasingly smaller hearing aids are produced. Those hearing aids have an increasingly higher comfort of wear and consequently are hardly perceived by a user when worn at or in an ear. However, as a result thereof, there is also increasingly the danger of a hearing aid falling out and being unnoticed by a user when worn and consequently being lost.

European Patent EP 2 150 076 B1, corresponding to U.S. Pat. No. 8,189,835, has disclosed a binaural hearing aid apparatus having two hearing aids which are signal-coupled by a radio link. In that case, each of the hearing aids monitors a signal level of the radio link. If one of the hearing aids falls down, the radio link is dropped, whereupon the other hearing aid automatically produces an information signal that is perceivable by the user. That provides a protection against loss for the hearing aids.

European Patent EP 2 109 331 B1, corresponding to U.S. Pat. No. 8,175,305, describes a hearing aid with a fall protection, wherein an acceleration sensor of the hearing aid captures a fall on the basis of a jerky acceleration of the hearing aid. In the case of a fall, the current settings of the hearing aid are stored in a memory in the process.

European Patent Application EP 3 035 710 A2, corresponding to U.S. Patent Application Publication 2017/0289704, relates to a monitoring system for one or more hearing aids. The monitoring system has a number of access points which are embodied to receive wireless radio signals from the hearing aids. In that case, the access points are coupled to one another by the Internet or a cloud. In that case, the monitoring system automatically monitors the status of one or more parameters of the hearing aids. In that case, the hearing aids have e.g. acceleration sensors, the measurement values of which are monitored as parameters.

International Publication WO 2014/184395 A2, corresponding to U.S. Patent Application Publication 2017/0238103, describes a binaural hearing aid with two hearing aids which are coupled by a Bluetooth communication link with a short range. Furthermore, the hearing aids are configured to couple to an external appliance by a second Bluetooth communication link with a comparatively large range.

SUMMARY OF THE INVENTION

It is accordingly an object of the invention to provide a method for operating a hearing aid apparatus and a hearing aid apparatus, which overcome the hereinafore-mentioned disadvantages of the heretofore-known methods and apparatuses of this general type.

With the foregoing and other objects in view there is provided, in accordance with the invention, a method for operating a hearing aid apparatus, which comprises:

- providing two hearing aids which are signal-coupled by a wireless first communication link with a comparatively short range and by a wireless second communication link with a comparatively long range,
- providing each hearing aid with an integrated motion sensor for capturing a fall of the respective hearing aid,
- in each hearing aid, a first signal level of the first communication link is monitored and compared to a stored first threshold,
- a notification signal is transmitted by the second communication link from the first of the two hearing aids when the motion sensor captures a fall and the first signal level reaches or drops below the first threshold, and
- upon reception of the notification signal, a perceivable first information signal is produced as a protection against loss by the second of the two hearing aids.

With the objects of the invention in view, there is also provided a hearing aid apparatus for carrying out the method according to the invention, which comprises two hearing aids which are signal-coupled by a wireless first communication link with a comparatively short range and by a wireless second communication link with a comparatively long range, each hearing aid having an integrated motion sensor for capturing a fall of the respective hearing aid, and the hearing aids being configured, by the second communication link, to be signal-coupled to a mobile operating and display appliance, in particular a smartphone.

The method according to the invention is suitable and configured for operating a hearing aid apparatus having two hearing aids (hearing aid appliances). During the operation of the hearing aid apparatus, the hearing aids are each preferably worn at a different ear of a user. The hearing aids of the binaural hearing aid apparatus, in particular, are signal-coupled by a wireless first communication link with a comparatively short range and by a wireless second communication link with a comparatively long range. This means that the second communication link has a greater range than the first communication link. In this case, a range should be understood to mean, in particular, the signal range; i.e., a maximum distance of the respective communication link which may exist between a transmitter and a receiver in such a way that communication between these two is still possible. Expediently, the hearing aids have appropriate transceivers (transmitter-receivers) for the communication links.

The communication links preferably have a bidirectional embodiment for a mutually alternating signal transfer between the hearing aids. In this case, in particular, a comparatively short range of the first communication link should be understood to mean a signal link between the hearing aids which, for example, drops in the case of a relative distance between the hearing aids of approximately 50 cm to 1 m. The comparatively long range of the second communication link is preferably assigned to a signal link between the hearing aids which, for example, is dropped in the case of a relative distance between the hearing aids of approximately 10 m.

The two hearing aids each have an integrated motion sensor for capturing a fall of the respective hearing aid. By way of example, the motion sensor is embodied as an acceleration sensor, preferably as a three-axis acceleration sensor, which captures the acceleration due to gravity during the fall and/or the jerky acceleration upon impact of the hearing aid on the ground. Additionally, or alternatively, it is likewise conceivable for use to be made of a gyroscopic (orientation) sensor which captures a fall due to an unusual rotation of the hearing aid.

According to the method, provision is made for a first signal level of the first communication link to be monitored as a measure for the signal strength between the hearing aids in each hearing aid during the operation of the hearing aid apparatus and for that signal level to be compared to a stored first threshold. In this case, a notification signal is sent from the first of the two hearing aids by the second communication link if its motion sensor captures a fall and the first signal level reaches or drops below the first threshold. In this case, reaching or dropping below the first threshold substantially corresponds to the first, short-range communication link between the two hearing aids being dropped. In this case, a drop should be understood to mean, in particular, an interruption, a disconnection or any other interference in the communication link which substantially prevents a signal transfer between the hearing aids.

Upon reception of the notification signal, the second of the two hearing aids produces a first information signal that is perceivable by the user as a protection against loss. As a result, a fall of the first hearing aid while being worn is signaled to the user, and therefore the risk of an unnoticed loss of the hearing aid is advantageously reduced. Consequently, a particularly suitable method for operating a hearing aid apparatus is realized.

A substantial difference from the prior art is that the hearing aids are coupled to one another by two wireless communication links with different ranges. In contrast to the prior art, the second hearing aid does not produce the information signal when the first communication link is dropped but only once it obtains the notification signal from the first hearing aid through the second communication link. Consequently, the signaling of a loss is triggered by proceeding from the first hearing aid, i.e. the hearing aid which has fallen or been lost, and therefore the additional information of the motion sensor is taken into account. Both hearing aids register the drop of the first communication link substantially simultaneously; however, only the falling (first) hearing aid captures a fall by the motion sensor. Expressed differently, it is clearly determinable which of the two hearing aids is lost; this would not be clearly identifiable by the hearing aids from only a drop in the first communication link.

Consequently, the method according to the invention provides a particularly advantageous protection against loss. In contrast to the prior art, the capture of the fall by the motion sensor is additionally used as a trigger criterion for the first information signal in addition to the binaural communication link between the hearing aids being dropped. As a result, it is possible in a simple and cost-effective manner to distinguish between an intended removal of the first hearing aid on one hand and an unwanted fall or loss of the first hearing aid on the other hand. The movement of the hearing aid captured by the motion sensor has, for example, a substantially lower acceleration in the case of an intended removal than in the case of falling during an unwanted fall.

Preferably, the hearing aids each have a controller, for example as part of a signal processing device. In this case, in general, the controllers of the hearing aids are configured, in terms of programming and/or circuitry, to carry out the method according to the invention described above. Consequently, the controllers are configured, in particular, to carry out a threshold comparison of the first signal level and evaluate a sensor signal of the motion sensor in the case of a fall and transmit the notification signal in a manner dependent thereon. Furthermore, the controllers are configured to cause the information signal for signaling to the user in the case of a reception of the notification signal.

At least at their core, the controllers are formed, in each case, by a microcontroller having a processor and a data memory, in which the functionality for carrying out the method according to the invention is implemented by programming in the form of operating software (firmware) in such a way that the method, optionally with interaction with a user, is carried out automatically when the operating software in the microcontroller is executed.

However, in a possible embodiment within the scope of the invention, the controllers are also formed alternatively by programmable electronic components, for example an application-specific integrated circuit (ASIC), in which the functionality for carrying out the method according to the invention is implemented by circuitry.

In an advantageous development, the notification signal is transmitted if the capturing of a fall and reaching or dropping below the first threshold occur within a predetermined time duration. This takes into account the circumstances that capturing of the fall and dropping of the first communication link need not necessarily occur simultaneously. By way of example, this is the case if the hearing aid is briefly caught on clothing of the user during the fall or if the user deliberately removes the hearing aid and the latter falls down in the process.

In principle, capturing the fall and dropping of the first communication link should have a little temporal proximity in such a way that the time duration is dimensioned to a few seconds in a possible development form. As a result, a reliable detection of a fall is ensured on the hand. On the other hand, the signaling by the information signal is effectuated as timely as possible in such a way that the user has not yet moved far away from the dropped hearing aid. This makes it easier for the user to find the (first) hearing aid.

In a possible configuration of the method, provision is made for an acoustic notification to be produced as a first information signal by the second hearing aid. In this case, for example, the acoustic notification is embodied as a beep or as a tone sequence or as a spoken message. In this case, the acoustic notification is produced in suitable fashion by an output transducer or loudspeaker (receiver) of the second hearing aid. As a result, easily perceivable signaling to the user is facilitated.

An additional or further aspect of the method according to the invention provides for a separate mobile operating and display appliance to be signal-coupled to the hearing aids by the second communication link. By way of example, the operating and display appliance is a cellular telephone, in particular a cellular telephone with a computer function or a smartphone, or else a tablet computer. According to the method, the operating and display appliance has stored application software (operating software), by which a second information signal is produced when the operating and display appliance receives the notification signal through the second communication link. To this end, the application software is preferably installable or installed on the operating and display appliance as a so-called app or mobile app (mobile application, smartphone app).

By way of example, the second information signal is embodied as an acoustic notification and/or optical communication and/or vibration signal from the operating and display appliance. As a result, the loss of the first hearing aid is signaled to the user both by the second hearing aid and by the operating and display appliance in such a way that particularly effective and reliable signaling is ensured. In particular, this ensures that signaling can be imparted to the user, even in the case of a loss of both hearing aids.

In this case, this development proceeds from the idea that modern operating and display appliances, such as, in particular, smartphones or tablet computers, are very widespread in current society and generally available and accessible to a user at all times. In particular, the user of the hearing aid apparatus has, with a high probability, substantially one such operating and display appliance in their household.

Furthermore, these days, modern smartphones are equipped with a multiplicity of different near field and far field communication measures as standard, as a result of which the second communication link to the hearing aids is establishable, in principle, in a simple manner. In this case, the application software is preferably also suitable and configured for setting operating parameters of the hearing aids, such as e.g. a volume. As a result, the user does not require an additional, separate operating system for monitoring the hearing aid apparatus. Instead, it is possible by way of (retrospectively) downloading and/or installing the application software to use their already available smartphone for determining and evaluating the operating or wear state. In this way, costs on the part of the user are advantageously reduced.

The surfaces of smartphones or tablet computers, which are typically embodied as touchscreens (displays), furthermore allow a particularly simple and intuitive operation of the application software by the operating and display appliance formed thereby. As a result, a smartphone or tablet computer can be retrofitted for monitoring the hearing aid apparatus in a particularly cost-effective manner.

The operating and display appliance includes an internal controller which, at least at its core, is formed by a microcontroller having a processor and a data memory, in which the functionality for carrying out the method is implemented by programming in the form of application software in such a way that the method or the determination of the operating state of the hearing aids, optionally with interaction with the user, is carried out automatically when the application software in the microcontroller is executed.

After receiving the notification signal, a second signal level of the second communication link is monitored and compared to a stored second threshold by the application software in an advantageous development. In this case, the second signal level is a measure for the signal strength or signal quality, or signal intensity, of the second communication link between the operating and display appliance and the hearing aids. In this case, it is conceivable, for example, that the second communication links to the two hearing aids are monitored separately from one another or that only the second communication link to the (first) hearing aid, which transmitted the notification signal, is monitored. Expediently, the hearing aids have an identification in this case, which is transmitted together with the notification signal, in such a way that it is possible to signal by using the application software, for example, which of the two hearing aids is lost.

In a preferred development, a third information signal is produced by the application software of the operating and display appliance when the second signal level reaches or drops below the second threshold. This improves the protection against loss of the hearing aid apparatus.

When the first hearing aid is lost, the first (short-range) communication link is interrupted, whereupon the first hearing aid transmits the notification signal to the second hearing aid and to the operating and display appliance through the second (long-range) communication link. Consequently, the loss is signaled while the user is still situated in close proximity to the first hearing aid. This close proximity is substantially limited by the range of the second communication link, and so the user not moving out of these surroundings involuntarily is ensured by the monitoring of the signal level of the second communication link by the operating and display appliance. In this case, the third information signal is embodied, in particular, as an alarm signal which signals to the user that they are moving away from the first hearing aid. As a result, the search for the first hearing aid after the loss thereof is substantially simplified since it is ensured that the user does not inadvertently search in the wrong surroundings or move too far away from the first hearing aid.

In this case, in a possible development, it is, for example, additionally or alternatively conceivable for the second signal level of the second communication link between the operating and display appliance and the first hearing aid to be evaluated as a measure for the relative distance. The closer the operating and display appliance and the first hearing aid, the higher the second signal level usually is. A distance value that is determinable therefrom is presentable on the display or indication device of the operating and display appliance by way of the application software in such a way that the search for the first hearing aid is further simplified for the user. As a result, the user, as a rule, does not require any further aids for finding the first hearing aid.

After reception of the notification signal from the first hearing aid, the operating and display appliance carries out a check as to whether or not the notification signal was received by the second hearing aid in an expedient configuration. In this case, a further or additional notification signal is transmitted by the operating and display appliance by using the second communication link to the second hearing aid if no reception confirmation of the notification signal is transmitted by the second hearing aid. This ensures that the user is informed about the loss of the first hearing aid in a timely manner.

In an advantageous embodiment, the operating and display appliance includes a device for determining a geographic position of the operating and display appliance. In this case, the device fittingly determines the position using a satellite signal and/or on the basis of a mobile radio signal. In particular, the device is preferably embodied as a GPS (global positioning system) receiver which is advantageously integrated as standard in smartphones and similar operating and display appliances. As a result, it is possible to determine the position of virtually any location. In this case, after reception of the notification signal, the current position is captured and stored by the application software. Consequently, this captured position provides an indication for the position of the first hearing aid, with the storage ensuring that the position can be retrieved without problems at a later time.

Suitably, the stored position is presentable on the display of the operating and display appliance, for example on a map, by the application software. This facilitates the retrieval of the position of the first hearing aid in a particularly simple manner. In this case, provision is made in a particularly advantageous embodiment for the position currently determined by the device to be presented by the application software in addition to the stored position, and therefore a directional specification and/or a distance specification is realized by way of a consequently facilitated determination of the relative position. As a result, a particularly targeted finding of the first hearing aid is ensured.

The hearing aid apparatus according to the invention is suitable and configured for carrying out the method described above. The hearing aid apparatus has two hearing aids which are signal-coupled by a wireless first communication link with a comparatively short range and by a wireless second communication link with a comparatively long range. In this case, each hearing aid has an integrated motion sensor for capturing a fall of the respective hearing aid, wherein the hearing aids are configured, by using the second communication link, to be signal-coupled to a mobile operating and display appliance, in particular a smartphone.

In an expedient configuration, the first communication link with a comparatively short range is an inductive coupling and the second communication link with a comparatively long range is a radio link. As a result, expedient first and second communication links are realized.

For inductive coupling, it is necessary, as a rule, for the involved transmitter and receiver coils of the hearing aids to be ideally aligned in relation to one another. Consequently, the first communication link has a high directionality in this configuration. When the first hearing aid is lost, the first communication link realized by the inductive coupling is therefore dropped both due to the increasing relative distance between the hearing aids and due to the deviating relative alignment in relation to one another. In particular, the first communication link is dropped faster than in the case of a comparable short-range radio link due to the directionality of the inductive coupling. As a result, the first signal level reaches or drops below the first threshold more reliably and within a shorter period of time, as a result of which the protection against loss of the hearing aid apparatus is substantially improved.

By way of example, the radio link is a radiofrequency link. However, a radio link based on a Bluetooth, WLAN (wireless local area network) or RFID (radio frequency identification) standard is likewise conceivable.

Other features which are considered as characteristic for the invention are set forth in the appended claims.

Although the invention is illustrated and described herein as embodied in a method for operating a hearing aid apparatus and a hearing aid apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
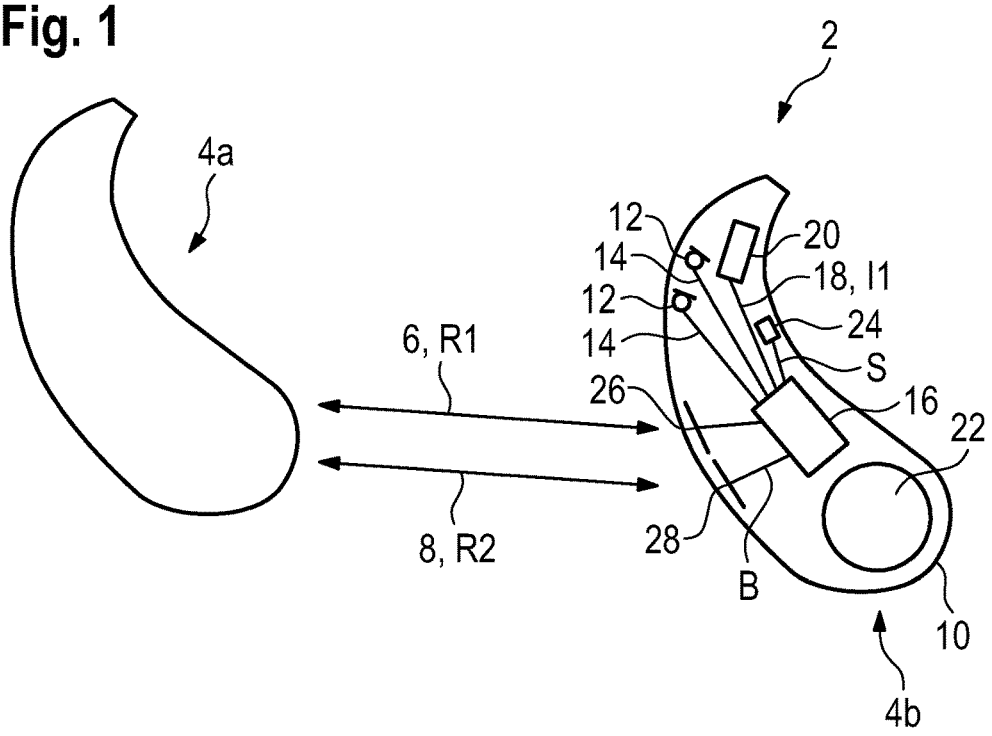
FIG. 1 is a diagrammatic, top-plan view of a hearing aid apparatus having two hearing aids which are signal-coupled to one another by a first communication link and a second communication link.

Referring now in detail to the figures of the drawings, in which parts and variables that correspond to one another are always provided with the same reference signs, and first, particularly, to FIG. 1 thereof, there is seen a basic structure of a hearing aid apparatus 2 according to the invention. In this exemplary embodiment, the hearing aid apparatus 2 has a binaural embodiment with two signal-coupled hearing aid appliances or hearing aids 4*a*, 4*b*. In this case, the hearing aids 4*a*, 4*b* are configured as behind-the-ear (BTE) hearing aid appliances in an exemplary manner. The hearing aids 4*a*, 4*b* have a bidirectional signal-coupling among themselves through the use of a first wireless communication link 6 and through the use of a second wireless communication link 8.

In this case, the communication link 6 has a shorter (signal or transmission) range than the communication link 8. Expressed differently, the communication link 6 is embodied with a comparatively short range R1 and the communication link 8 is embodied with a comparatively long range R2. In particular, the communication link 6 is an inductive coupling between the hearing aids 4*a* and 4*b*, with the communication link 8 preferably being embodied as a radio connection, for example as a Bluetooth or RFID connection, between the hearing aids 4*a* and 4*b*.

With a suitable dimensioning, the communication link 6 has, for instance, a range R1 of 50 cm. In this case, the range R2 of the communication link 8 is preferably dimensioned to approximately 10 m.

The structure of the hearing aids 4*a*, 4*b* is explained below in an exemplary manner using the hearing aid 4*b*. As is illustrated diagrammatically in FIG. 1, the hearing aid 4*b* includes an appliance housing 10, in which one or more microphones, also referred to as acousto-electric transducers 12, are installed. The sound or the acoustic signals from the surroundings are recorded and converted into an electric audio signal 14 by using the microphones 12.

The audio signal 14 is processed by a signal processing device 16, which is likewise disposed in the appliance housing 10. On the basis of the audio signal 14, the signal processing device 16 produces an output signal 18 which is guided to a loudspeaker or receiver 20. In this case, the receiver 20 is embodied as an electro-acoustic transducer 20 which converts the electric output signal 18 into an acoustic signal and outputs the latter. In the case of the BTE hearing aid appliance 4*b*, the acoustic signal is transferred, where necessary, by way of a sound tube or external receiver (not illustrated in detail in this case), which has an ear mold seated in the auditory canal, leading to the eardrum of a hearing aid apparatus user. However, e.g. an electromechanical transducer is likewise conceivable as a receiver 20, such as, for example, in the case of a bone conduction receiver.

The energy supply of the hearing aid appliance 4*b* and, in particular, of the signal processing device 16 is effectuated by a battery 22 that is received in the appliance housing 10.

The signal processing device 16 is coupled to a motion sensor 24, embodied by way of example as an acceleration sensor, of the hearing aid 4*b*. During operation, the motion sensor 24 captures acceleration and/or rotational movements of the hearing aid 4*b* and the motion sensor is suited and configured, in particular, to capture a fall of the hearing aid 4*b* and to transmit a corresponding fall signal S to the signal processing device 16.

Furthermore, the signal processing device 16 is guided, in terms of signals, to a first transceiver 26 and a second transceiver 28 of the hearing aid 4*b*. The transceiver 26 serves to transmit and receive wireless signals over the communication link 6 and the transceiver 28 serves to transmit and receive wireless signals over the communication link 8. Expressed differently, the communication link 6 is produced between the transceivers 26 of the hearing aids 4*a* and 4*b* and the communication link 8 is produced between the transceivers 28 of the hearing aids 4*a* and 4*b* during the operation of the hearing aid apparatus 2. In this case, for example, the transceiver 26 is embodied as an induction coil.

Figure 2:
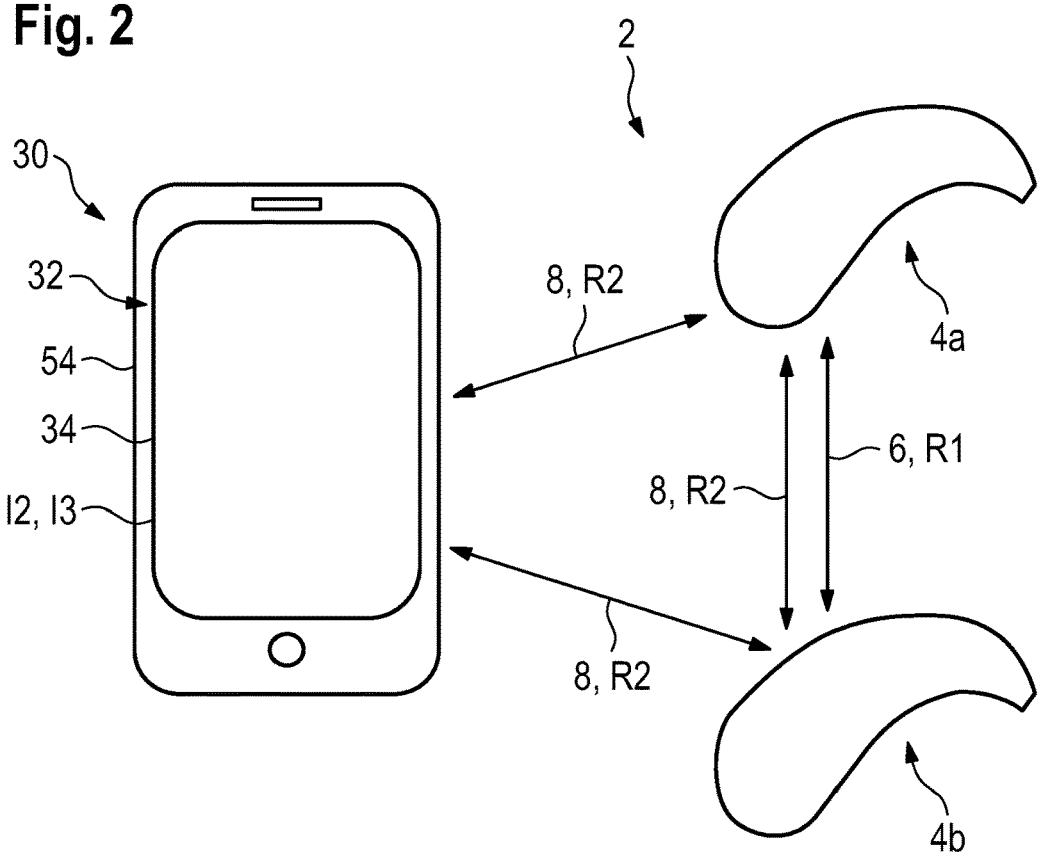
FIG. 2 is a top-plan view of a hearing aid apparatus according to FIG. 1, which is signal-coupled to a mobile operating and display appliance by the second communication link.

In the exemplary embodiment of FIG. 2, a separate, mobile, operating and display appliance 30 is signal-coupled to the hearing aid apparatus 2 by the communication link 8. The operating and display appliance 30 illustrated diagrammatically in FIG. 2 is a smartphone, in particular. The smartphone 30 has a touch-sensitive display unit (display) 32, which is also referred to as a touchscreen below. Expediently, the smartphone 30 is introduced into the transmission range of the communication link 8 in this case and consequently is at a distance from the hearing aids 4*a*, 4*b* which is less than the range R2. In particular, the smartphone 30 has been brought up to a distance of a few centimeters from the hearing aid apparatus 2. The signal-coupling between the smartphone 30 and the transceivers 28 of the hearing aids 4*a* and 4*b* is effectuated in this case by way of an appropriate integrated transceiver, which is not denoted in any more details of the smartphone 30, for example a radio antenna.

The smartphone 30 has an integrated controller which is substantially formed by a microcontroller with implemented application software 34 for evaluating, by programs, the signals transmitted by the communication link 8. The application software 34 is preferably a mobile app or a smartphone app which is stored in a data memory of the controller. During operation, the controller presents the application software 34 on the touchscreen 32, wherein the application software 34 is operable by a user by using the touch-sensitive surface of the touchscreen 32.

Figure 3:
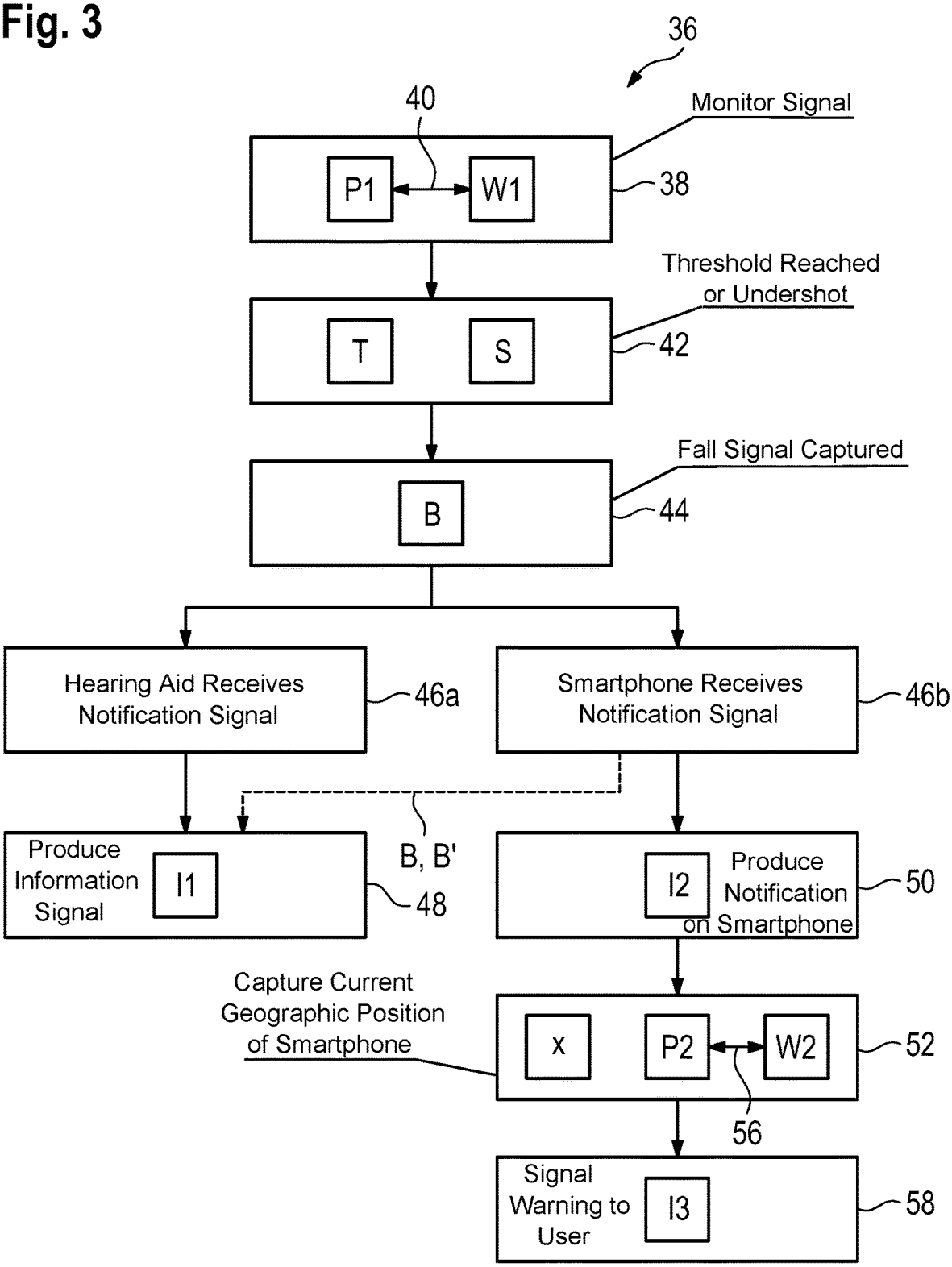
FIG. 3 is a flowchart of a method for operating the hearing aid apparatus.

A method 36 according to the invention for operating the hearing aid apparatus 2 is explained below on the basis of the flowchart illustrated in FIG. 3.

The method 36 is suited and configured, in particular, for protection against loss. During normal operation of the hearing aid apparatus 2, the hearing aids 4*a* and 4*b* are worn on the ears of a hearing aid apparatus user. In this case, the hearing aids 4*a* and 4*b* are coupled for mutual signal transfer by the communication links 6 and 8. In this case, the hearing aids 4*a* and 4*b* are furthermore optionally signal-coupled to the smartphone 30 by the communication link 8.

In a first method step 38 of the method, the respective signal processing device 16 of the hearing aids 4*a*, 4*b* monitors the signal strength or signal intensity of the signals transmitted by the communication link 6. This captured signal level P1 of the communication link 6 is compared to a threshold W1 stored in the signal processing device 16 within the scope of a threshold comparison 40.

Below, the method is described, in particular, for the loss of the hearing aid 4*b*, with the following description being applicable in an analogous manner for the loss of the hearing aid 4*a*.

When the hearing aid 4*b* is lost, for example when the hearing aid 4*b* drops without being perceived by the user, the communication link 6 drops during the first method step 38. Expressed differently, the communication link 6 is interrupted or disconnected. As a result, the signal level P1 captured at the transceiver 26 reaches or drops below the threshold W1.

The respective signal processing device 16 starts a method step 42 in the case in which the threshold W1 is reached or undershot. If the signal processing device 16 captures the fall signal S of the motion sensor 24 within a predetermined time duration T, a method step 44 is started. Alternatively, a fall captured by the fall signal S of the motion sensor 24 is used in the method step 38 as a trigger criterion for the method step 42, in which, accordingly, the threshold comparison 40 is evaluated during the time duration T.

By way of the evaluation according to the invention of the drop of the binaural communication link 6 between the hearing aids 4*a* and 4*b* on one hand and the additional capture of the fall by the motion sensor 24 on the other hand, the method steps 38 and 42 render it possible to distinguish between a desired removal of the hearing aid 4*b* on one hand and an unwanted fall or loss of the hearing aid 4*b* on the other hand.

If a loss is identified, the signal processing device 16 triggers the method step 44. In this case, the signal processing device 16 produces a notification signal B, which is transmitted to the transceiver 28. The transceiver 28 transmits the notification signal B to the hearing aid 4*a* and the smartphone 30 over the longer-range communication link 8.

The hearing aid 4*a* receives the notification signal B by the transceiver 28 in a method step 46*a* and the smartphone receives the notification signal in a method step 46*b*.

When the notification signal B is received in the method step 46*a*, a method step 48 is started in the hearing aid 4*a*. In this case, an information signal I1 is produced by the signal processing device 16. In this case, the information signal I1 is transmitted to the receiver 20 in place of the output signal 18 and signaled to the user in an acoustically perceivable manner as an acoustic notification, for example in the form of a warning tone or a spoken communication regarding the loss.

If the notification signal B is received in the method step 46*b*, a method step 50 is started in the smartphone 30. In this case, an information signal I2 is produced by the application software 34. By way of example, the information signal I2 is an acoustic notification in the form of a ring tone of the smartphone 30 or an optical communication on the touchscreen 32 or a vibration signal, or a combination thereof.

Optionally, the smartphone 30 checks, in the method step 46*b*, whether or not the hearing aid 4*a* has received the notification signal B of the hearing aid 4*b*. If the smartphone 30 does not receive a reception confirmation from the hearing aid 4*a* within a predetermined time duration, the smartphone 30 transmits the notification signal B or a further notification signal B' to the hearing aid 4*a* in such a way that the method step 48 is triggered. This is illustrated diagrammatically in FIG. 3 by a dashed arrow.

The smartphone 30 starts a method step 52 after producing the information signal I2. In the method step 52, the smartphone 30 captures a current geographic position x of the smartphone 30 by using an integrated device 54, which is preferably embodied as a GPS receiver. The position x is stored in a memory of the smartphone 30 by the application software 34. Consequently, the position x corresponds to the proximity of the lost hearing aid 4*b*. Additionally, the application software 34 monitors a signal level P2 of the communication link 8, i.e. the signal strength between the smartphone 30 and the hearing aid 4*a*. In this case, the signal level P2 is compared to a stored second threshold W2 within a threshold comparison 56.

A method step 58 is started by the application software 34 if the signal level P2 reaches or drops below the threshold W2. An information signal I3 is produced in the method step 58. As a warning signal, the information signal I3 signals to a user that he or she is moving away from the hearing aid 4*b*. The threshold W2 is preferably dimensioned in such a way that in this case it corresponds to a relative distance or spacing between the smartphone 30 and the hearing aid 4*b* that is less than the range R2. As a result, the information or warning signal I3 is triggered before the user has moved further away from the lost hearing aid 4*b* than the range R2.

Consequently, the smartphone 30 acts effectively as a proximity sensor for the hearing aid 4*b* by evaluating the signal level P2. Additionally, the stored position x can preferably be recalled at all times together with a direction by the device 54 by using the application software 34 in such a way that, for example, a numerical value for the relative distance and/or a directional specification to the hearing aid 4*b* are displayable on the touchscreen 32.

The method 36 provides a reliable and accurate protection against loss for the hearing aids 4*a* and 4*b*. In particular, in combination with the application software 34 installed on the smartphone 30, this yields a particularly suitable method for avoiding a loss of the hearing aid and for retrieving a lost hearing aid.

The invention is not restricted to the exemplary embodiments described above. Rather, other variants of the invention can also be derived therefrom by a person skilled in the art, without departing from the subject matter of the invention. In particular, all individual features described in the context of the exemplary embodiments are, further, also combinable with one another in a different way without departing from the subject matter of the invention.

The following is a summary list of reference numerals and the corresponding structure used in the above description of the invention. List of reference signs:

2 Hearing aid apparatus
4*a*, 4*b* Hearing aid
6 Communication link
8 Communication link
10 Appliance housing
12 Microphone/transducer
14 Audio signal
16 Signal processing device
18 Output signal
20 Receiver/transducer
22 Battery
24 Motion sensor
26 Transceiver
28 Transceiver
30 Operating and display appliance/smartphone
32 Display unit/touch screen
34 Application software
36 Method
38 Method step
40 Threshold comparison
42, 44 Method step
46*a*, 46*b* Method step
48, 50, 52 Method step
54 Device
56 Threshold comparison
58 Method step
R1, R2 Range
S Fall signal
B, B' Notification signal
I1, I2, I3 Information signal
P1, P2 Signal level
W1, W2 Threshold
T Time duration
x Position

The invention claimed is:

1. A method for operating a hearing aid apparatus, the method comprising the following steps:

providing first and second hearing aids being signal-coupled by a wireless first communication link with a comparatively short range and by a wireless second communication link with a comparatively long range, and providing each of the hearing aids with a respective integrated motion sensor for capturing a fall of a respective hearing aid;

monitoring a first signal level of the first communication link in each hearing aid and comparing the first signal level to a stored first threshold;

transmitting a notification signal from the first hearing aid over the second communication link when the motion sensor captures a fall and the first signal level reaches or drops below the first threshold; and using the second hearing aid to produce a perceivable first information signal upon reception of the notification signal as a protection against loss.

2. The method according to claim 1, which further comprises carrying out the step of transmitting the notification signal if the capturing of a fall and reaching or dropping below the first threshold occur within a predetermined time duration.

3. The method according to claim 1, which further comprises using the second hearing aid to produce an acoustic notification as the first information signal.

4. The method according to claim 1, which further comprises:

signal-coupling a mobile operating and display appliance to the hearing aids over the second communication link; and storing application software in the operating and display appliance for producing a second information signal when the operating and display appliance receives the notification signal.

5. The method according to claim 1, which further comprises providing a smartphone as the mobile operating and display appliance.

6. The method according to claim 4, which further comprises, after receiving the notification signal, using the application software to monitor a second signal level of the second communication link and to compare the second signal level to a stored second threshold.

7. The method according to claim 6, which further comprises using the application software of the operating and display appliance to produce a third information signal when the second signal level reaches or drops below the second threshold.

8. The method according to claim 4, which further comprises:

after receiving the notification signal from the first hearing aid, using the operating and display appliance to carry out a check as to whether or not the notification signal was received by the second hearing aid; and using the operating and display appliance to transmit a further notification signal over the second communication link to the second hearing aid if no reception confirmation of the notification signal is transmitted by the second hearing aid.

9. The method according to claim 4, which further comprises providing the operating and display appliance with a device for determining a geographic position of the operating and display appliance, and using the application software to capture and store the current position after reception of the notification signal.

10. A hearing aid apparatus, comprising:

two hearing aids being signal-coupled by a wireless first communication link having a comparatively short range and by a wireless second communication link having a comparatively long range;

each of said hearing aids having a respective integrated motion sensor for capturing a fall of a respective hearing aid;

said hearing aids being configured to be signal-coupled over said second communication link to a mobile operating and display appliance; and a signal processing device configured for:

monitoring a first signal level of said first communication link in each hearing aid and comparing the first signal level to a stored first threshold, and transmitting a notification signal from said first hearing aid over said second communication link when said motion sensor captures a fall and the first signal level reaches or drops below the first threshold;

said second hearing aid producing a perceivable first information signal upon reception of the notification signal as a protection against loss.

11. The hearing aid apparatus according to claim 10, wherein the mobile operating and display appliance is a smartphone.

12. The hearing aid apparatus according to claim 10, wherein said first communication link having a comparatively short range is an inductive coupling, and said second communication link having a comparatively long range is a radio link.

* * * * *